United States Patent [19]

Hutcheson

[11] 4,051,575

[45] Oct. 4, 1977

[54] PROCESS OF PRODUCING SLIVERS FOR OPEN-END SPINNING

[75] Inventor: William Frank Hutcheson, Lookout Mountain, Tenn.

[73] Assignee: Rossville Yarn Processing Company, Rossville, Ga.

[21] Appl. No.: 690,297

[22] Filed: May 26, 1976

[51] Int. Cl.[2] ..... D01G 15/46

[52] U.S. Cl. ..... 19/151; 19/159 R; 19/163

[58] Field of Search ..... 19/151, 152, 153, 150, 19/159 R, 106 R, 163, 267; 57/34 R, 50

[56] References Cited

U.S. PATENT DOCUMENTS

| | | | |
|---|---|---|---|
| 382,908 | 5/1888 | Scholes | 19/152 |
| 2,964,801 | 12/1960 | Riehl et al. | 19/163 X |
| 3,815,179 | 6/1974 | Moore et al. | 19/163 |

FOREIGN PATENT DOCUMENTS

| | | | |
|---|---|---|---|
| 76,126 | 7/1894 | Germany | 19/151 |
| 1,171,632 | 11/1969 | United Kingdom | 19/267 |

*Primary Examiner*—Dorsey Newton

*Attorney, Agent, or Firm*—Bell, Seltzer, Park & Gibson

[57] ABSTRACT

A process of producing slivers for open-end spinning of wool or synthetic yarn and being characterized by eliminating the necessity for repeated doublings and draftings of the sliver while providing the desired uniform fiber distribution and weight in the sliver and yarn. Stock material is carded, then cross-lapped to reorient the fiber distribution, and again carded for producing a fiber web. This web is divided into relatively narrow rovings or strips of fibers and oriented into groups containing alternate strips of fibers from across the width of the fiber web. The respective strips of fibers from each such group are combined and formed into a sliver.

4 Claims, 7 Drawing Figures

PROCESS OF PRODUCING SLIVERS FOR OPEN-END SPINNING

The invention relates to a process of producing sliver for open-end spinning of wool or synthetic yarn and being characterized by eliminating the necessity for repeated doublings and draftings of the sliver with separate drafting machines while providing the desired uniform fiber distribution and weight in the sliver and yarn.

BACKGROUND OF THE INVENTION

Heretofore, in producing wool or synthetic textile fiber slivers and spinning yarns with open-end spinning machines, the usual process and apparatus utilized include the following. A two cylinder compact carding machine was provided for carding stock material and producing two slivers by splitting the ultimate carded web produced down the middle. The thus produced slivers were first fed to a conventional textile roller or pin drafting machine or other type of drafting machines which receive approximately ten of these carded slivers and doubled and drafted these ten slivers into one sliver. Approximately three of the thus doubled and drafted slivers were then fed to a second roller or pin drafting machine for doubling and drafting these three slivers into one sliver for use in spinning yarn in an open-end spinning machine. These doubling and drafting operations were essential with the use of the compact cards for purposes of obtaining the desired uniform fiber distribution and weight in the ultimate sliver produced to satisfactorily spin yarn in an open-end spinning machine. The resulting sliver comprised a continuous length of carded and drafted textile fibers disposed in an integrated mass and spun into yarn in an open-end spinning machine.

While the above described prior apparatus and process produced a desirable wool or synthetic sliver and an open-end spun yarn, the process and apparatus necessarily involved the use of a substantial amount of machines, a substantial labor force for operating and maintaining such machines, and was limited in its versatility in the staple length of fibers which could be processed. The compact carding machines are usually operated to card staple length wool or synthetic fibers generally between about four inches and eight inches and open-end spinning machines for wool and synthetic yarns usually operate on fibers of up to about six inches staple length.

OBJECTS AND SUMMARY OF THE INVENTION

Accordingly, it is the object of this invention to provide an improved process, apparatus and sliver product for open-end spinning of wool or synthetic yarn which will eliminate some of the machinery necessary with the prior conventional process, reduce labor requirements necessary and provide more variety in the staple length of the fibers which can be utilized.

It has been found by this invention that the above object may be accomplished by providing a process and apparatus producing wool and synthetic textile slivers for spinning yarns with open-end spinning machines and being characterized by eliminating the repeated doublings and draftings with separate drafting machines in such process and apparatus while producing slivers and yarn of the desired uniform fiber distribution and weight, including the following steps and apparatus.

Wool or synthetic stock fibrous material is carded in a textile card, preferably a breaker card of a woolen carding system, for forming a carded fiber web. The carded web is then cross-lapped to reorient and improve the fiber distribution. The cross-lapped web is again carded in a textile card, preferably a finished card of a woolen carding system, for forming a second carded fiber web. The second carded fiber web is divided, preferably in a tape condenser mechanism, into relatively narrow rovings or strips of fibers and are formed into a plurality of groups containing strips of fibers from different areas of the web and preferably from across substantially the full width of the second carded fiber web for evening the fiber distribution and weight in each such group of fiber strips. The respective strips of fibers from each such group are combined, preferably with separate coiling heads of a textile coiler mechanism, and formed into slivers of fibers which are fed directly into and spun into yarns in an open-end spinning machine without the necessity of doublings and draftings of the slivers before spinning.

While the use of a breaker card and a finisher card of a woolen carding system is the preferred apparatus for use in the present process, it has been found by this invention that other types of textile cards, including compact cards, may be utilized wherein a cross-lapping operation for evening fiber distribution and weight is performed between the tandum carding operations. Also, while a tape condenser is the preferred apparatus for use in the process of this invention for dividing the carded web into relatively narrow rovings or strips of fibers and forming the strips of fibers into a plurality of groups from different areas of the web, other mechanisms for dividing and forming of groups, such as a ring doffer or similar system, may be utilized.

The sliver produced comprises a continuous, relatively loose bundle of strips of fibers divided from alternate areas across the width of the carded fiber web produced in the woolen carding system. The resulting package comprises overlying layers of coiled sliver as defined above.

By use of the process and apparatus of this invention in which (1) the cross-lapper reorients and improves fiber distribution and weight, and (2) the carded web is divided into strips and strips are combined from different areas across such carded web and formed into slivers, the desired uniform fiber distribution and weight are obtained without the necessity for doublings and draftings with separate drafting machines which was required in the prior conventional process and apparatus.

The woolen carding system, which is the preferred form of apparatus, has the capacity for satisfactorily processing staple length wool or synthetic fibers from about one-half inch to about six inches and, therefore, provides greater versatility in the staple length fibers utilized for forming the sliver for spinning yarns in the open-end spinning machines which will accommodate fiber length up to about six inches.

BRIEF DESCRIPTION OF THE DRAWINGS

Some of the objects of the invention having been stated, other objects will appear as the description proceeds when taken in conjunction with the accompanying drawings, in which.

DESCRIPTION OF PREFERRED EMBODIMENT

Figure 5:
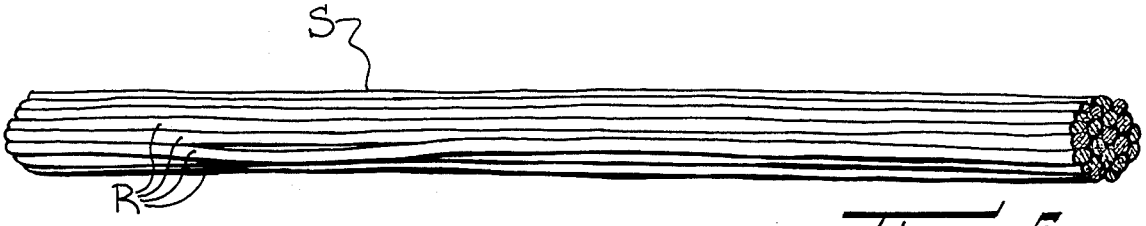
FIG. 5 is a schematic, perspective view of a length of a sliver produced in accordance with this invention.
Figure 6:
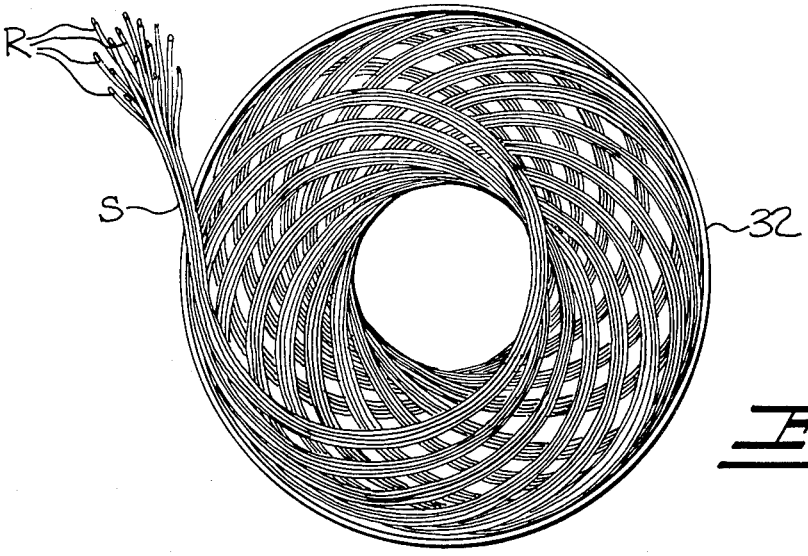
FIG. 6 is a schematic, top elevational view, partly in perspective, of the improved package of sliver produced in accordance with this invention.
Figure 7:
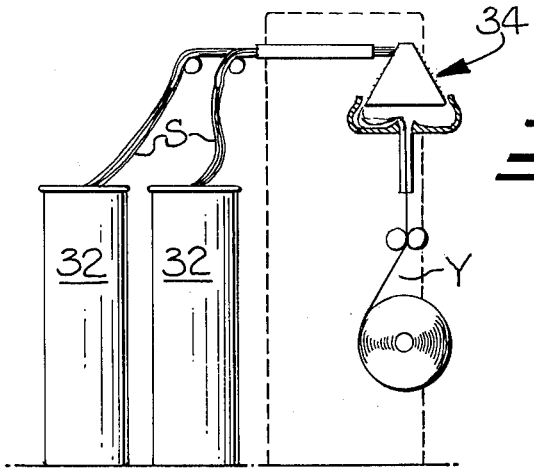
FIG. 7 is a schematic, side elevational view of the package of sliver produced in accordance with this invention being fed into an open-end spinning machine.

Referring now to the drawings, a preferred arrangement of apparatus is illustrated therein for producing the sliver product S of this invention, particularly shown in FIGS. 5 and 6, and yarn Y by the process of this invention.

Figure 1:
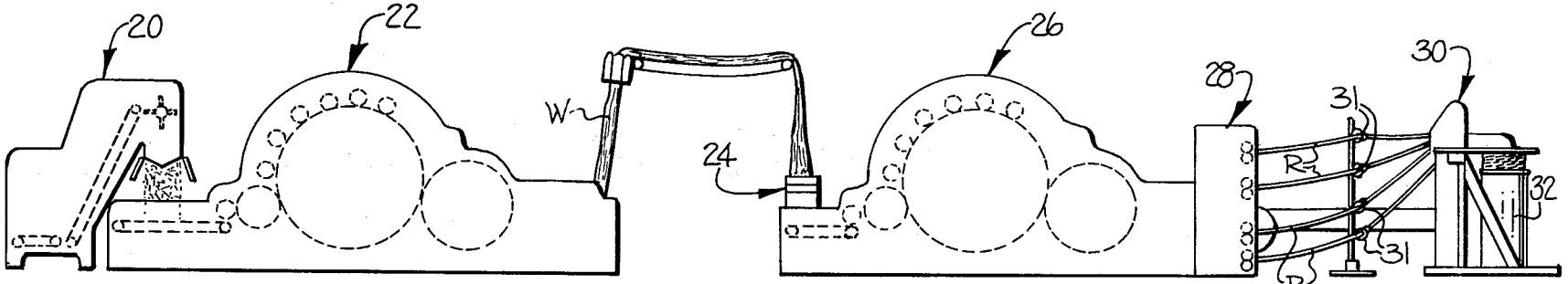
FIG. 1 is a schematic, side elevational view of a preferred arrangement of apparatus utilized in the present invention.
Figure 2:
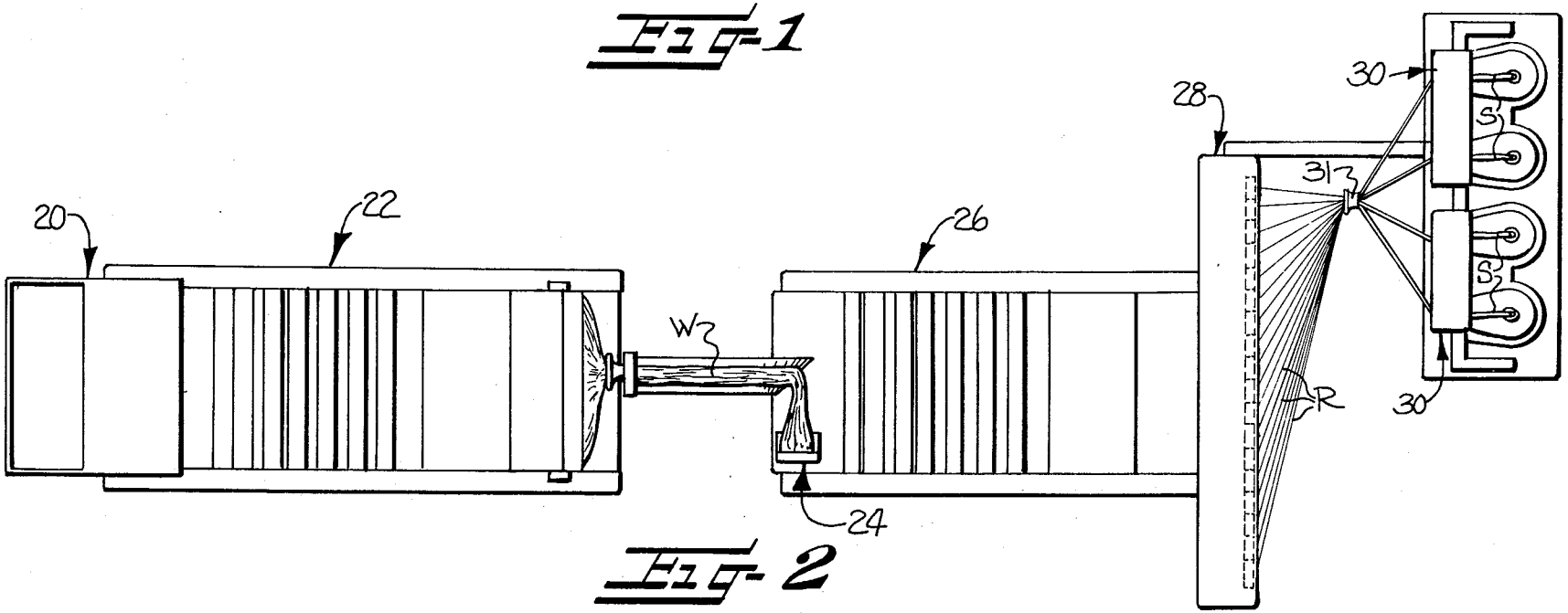
FIG. 2 is a schematic, top elevational view of the apparatus of FIG. 1.

As shown in FIGS. 1 and 2, stock fibrous material of desired wool or synthetic fibers, are prepared and fed to the combination of apparatus of this invention by a conventional card feeder 20 or other suitable apparatus. This stock material is received by the feed apron of a breaker or first card 22 of a woolen carding system. As is well known by those with ordinary skill in the art, the first or breaker card of a woolen carding system is intended to do the preliminary rough work on the stock fibrous material and cards the stock fibrous material to open and even the fibers. The construction and operation of a breaker card of a woolen carding system is well understood by those with ordinary skill in the art and further explanation herein is not deemed necessary for an understanding of this invention.

The carded web W formed by the breaker card 22 is condensed in the usual manner and is received by a cross-lapping mechanism 24, which may be in the form of a conventional scotch feeder. The cross-lapping mechanism 24 cross-laps the carded web W from the breaker card 22 onto the usual feed apron of a finisher card 26. The cross-lapping mechanism is constructed and operates in a manner well understood by those with ordinary skill in the art for reorienting the direction of fiber extension for improving and evening the fiber distribution and weight in the carded web W.

The cross-lapped fiber web W is then carded in the finisher card 26 of the woolen carding system for further opening and evening of the fibers thereof. Again, the construction and operation of a finisher card of a woolen carding system is well understood by those with ordinary skill in the art and further explanation herein is not deemed necessary for an understanding of this invention. If desired, an intermediate or second breaker card may be present in the woolen carding system utilized in this invention.

As mentioned above, the woolen carding system including a breaker card 22 and a finisher card 26, with a cross-lapping mechanism 24 therebetween, is the preferred arrangement of apparatus for the process of this invention, particularly when processing short staple length fibers because the cards of the woolen carding system have more carding points compared to compact cards. However, it has been found by this invention that compact cards may be utilized for longer staple length fibers as long as a cross-lapping mechanism 24 is utilized between such compact cards positioned in tandem.

Figure 3:
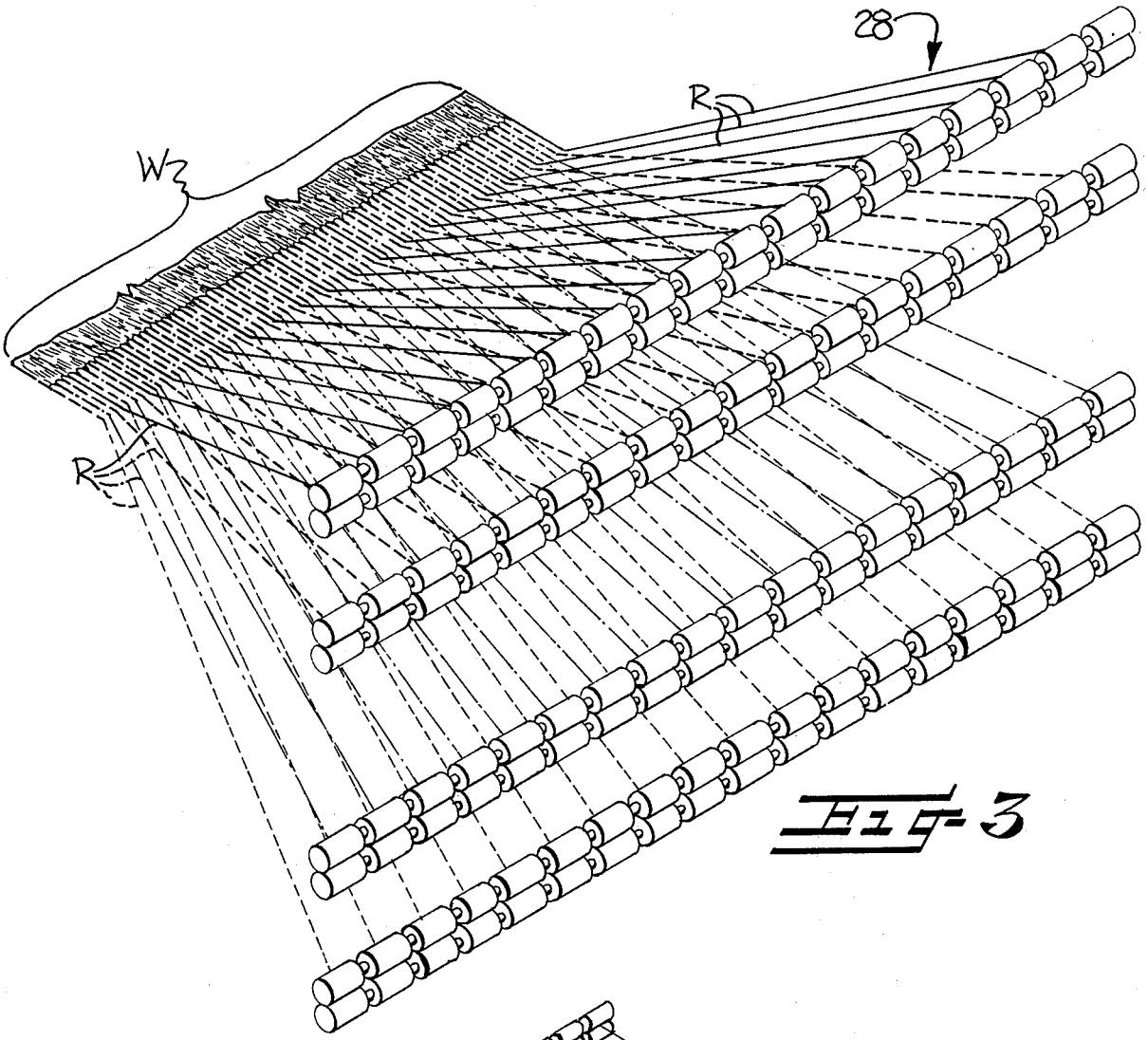
FIG. 3 is a schematic, perspective view illustrating the dividing of the carded fiber web into narrow strips and forming such strips into groups of alternate strips of fibers from across the width of the carded web.

The thus formed twice carded and cross-lapped web W is split or divided into a plurality of relatively narrow strips, ropings or rovings R of fibers and the strips R of fibers are oriented and formed into groups or layers, as shown particularly in FIG. 3, in which each group or layer contains alternate strips R of fibers from across the width of the carded web W for evening the fiber distribution and weight in each such group of fiber strips R.

This splitting or dividing of the second carded web W from the finisher card 26 and forming of groups of the strips or ropings R of fibers is preferably performed in a conventional tape condenser mechanism 28. The construction and operation of such tape condenser mechanism for splitting the carded web W from a finisher card 26 of a woolen carding system into individual strips or ropings R is well understood by those with ordinary skill in the art and further detailed explanation is not deemed necessary herein for an understanding of this invention.

While the use of a tape condenser mechanism is preferred, other mechanisms, such as a ring doffer or similar system, may be utilized.

As shown schematically in FIG. 3, the carded web W from the finisher card 26 may be divided into seventy-two strips or ropings R of fibers and may be oriented into four generally horizontally-extending, vertically-spaced, groups or layers of eighteen strips R in which each such group or layer contains each of the fourth alternating strips R of fibers from across the width of the divided second carded fiber web W from the finisher card 26. This would be the preferred arrangement when utilizing a sixty inch width finisher card, as shown in the system illustrated in the drawings.

If a seventy-two inch width finisher card of a woolen carding system is utilized, the resulting carded web W would preferably be split into two webs and then divided into one hundred twenty strips or ropings R of fibers and oriented into generally horizontally-extending, vertically-spaced layers or groups of strips R in which each such group contains alternating strips of fibers from across the width of the respective split webs from the finisher card.

By this orientation of the divided strips or ropings R, any unevenness or non-uniformity in fiber distribution or weight across the width of the second carded web W from the finisher card, as might occur in a particular area of the second carded web W, will be distributed evenly throughout each of the groups or layers of strips or ropings R formed.

Next, all of the respective strips of fibers R from each respective group or layer are combined and formed into a sliver S of fibers. Preferably, this combining of the strips R and forming of a sliver S is performed in a conventional textile coiler mechanism or mechanisms 30 constructed and operated in a manner well understood by those with ordinary skill in the art and having a separate coiling head or station, as may be seen particularly in FIG. 2, for receiving the strips R of fibers from each of the respective groups formed in the tape condenser mechanism 28. Each of the coiling heads of the coiler mechanism 30 will coil the resulting sliver S of fibers into a package of overlying layers of slightly coiled sliver, as shown in FIG. 6, in a coiler can 32 which is dimensioned for use with and for feeding of the sliver X into conventional open-end spinning machines 34 for the spinning of each of the slivers S into yarn Y.

Figure 4:
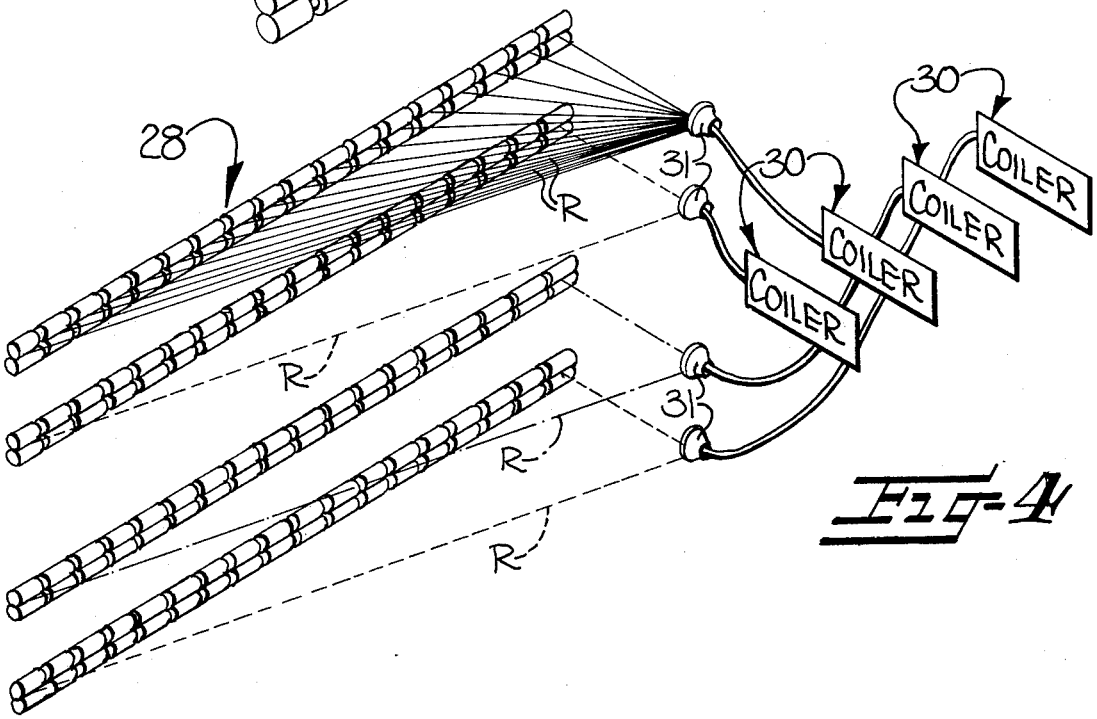
FIG. 4 is a schematic view illustrating the combining and forming of a sliver of the respective strips of fibers of each group.

As may be seen, particularly in FIGS. 2 and 4, the strips or ropings R of each formed group are fed through a separate trumpet mechanism 31 for combining thereof just prior to being received by the separate coiler heads of the coiler mechanism 30. These trumpet mechanisms 31 are preferably positioned at a longitudinally off set location with respect to the web W and divided strips R so that, as the individual strips R of each group are fed to the respective trumpet mechanisms 31, the strips of fibers R are combined at different longitudinal locations along each strip for further evening of fiber distribution and weight. As may be clearly seen in FIG. 4, the length of the strip R on the right-hand side of the top layer or groups of strip R has a shorter dimension from the tape condenser mechanism 28 to the trumpet mechanism 31 than does the strip of fibers R on the extreme left-hand side.

As may be clearly seen in FIGS. 5 and 6, the sliver S produced by the process and apparatus of this invention differs from the conventional integrated fiber sliver, which would be produced with doublings and draftings in roller or pin drafting machines utilized in the prior process, by comprising a continuous length of a relatively loose bundle of strips or ropings R of fibers divided from alternate areas across the width of a carded fiber web W produced in a woolen carding system.

As discussed above, inasmuch as the first carded web W is cross-lapped between the tandem carding operations and inasmuch as the ultimate or second carded web W is split or divided into strips or ropings R and oriented or formed into groups or layers containing alternate strips R from different areas across the width of the second carded fiber web W, the desired uniform fiber distribution and weight in the slivers S formed from each of the groups or layers of fiber strips R is provided for satisfactorily spinning yarns in an open-end spinning machine, without the necessity of repeated doublings and draftings of slivers S in separate drafting machines, as was necessary in the above described prior conventional process and apparatus. While these drafting and doubling operations would not be harmful in the process of this invention, these operations are not necessary. Elimination of these drafting operations reduces the amount of machines necessary, cuts down on the labor force required for maintenance and operations of such machines and produces a novel sliver S which may be satisfactorily spun in an open-end spinning machine. Also, the staple fiber lengths of the wool or synthetic fibers processed by the preferred apparatus, i.e. woolen carding system, into the sliver S of this invention may be shorter staple length, i.e. about one-half inch to six inches, as compared to those which could be produced in the conventional prior process and apparatus.

In the drawings and specification, there has been set forth a preferred embodiment of this invention and although specific terms are employed, they are used in a generic and descriptive sense only and not for purposes of limitation.

What is claimed is:

1. A process of producing slivers of textile fibers for spinning yarns with open-end spinning machines and being characterized by uniform fiber distribution and weight along the length of the sliver without the necessity of repeated doublings and draftings heretofore required to produce such slivers, said process comprising the steps of:

forming a first carded web by carding textile fibrous material in a textile card;

cross-lapping the first carded web to reorient and improve the fiber distribution;

forming a second carded web by carding the cross-lapped carded web in a textile card;

dividing the second carded web into relatively narrow rovings and forming a plurality of groups containing a plurality of the rovings with each group containing rovings from different areas across the width of the second carded web for evening the fiber distribution and weight in each such group of rovings; and combining all of the rovings of each group with each other and forming a sliver of such rovings for use in spinning yarn in an open-end spinning machine without the necessity of subsequent doublings and draftings.

2. A process, as set forth in claim 1, in which said step of dividing the second carded web into relatively narrow rovings and forming a plurality of groups comprises forming of groups in which each group contains rovings from different areas across substantially the full width of the second carded web.

3. A process, as set forth in claim 1, in which said step of combining all of the rovings of each group and forming a sliver of such rovings comprises combining the rovings at different longitudinal locations along each roving for further evening of fiber distribution and weight.

4. A process of producing slivers of textile fibers for spinning yarns with open-end spinning machines and being characterized by uniform fiber distribution and weight along the length of the sliver without the necessity of repeated doublings and draftings heretofore required to produce such slivers, said process comprising the steps of:

forming a first carded web by carding textile fibrous material in a breaker card of a woolen carding system;

cross-lapping the first carded web to reorient and improve the fiber distribution;

forming a second carded web by carding the cross-lapped web in a finisher card of a woolen carding system;

feeding the last produced carded fiber web into and through a tape condenser mechanism while dividing the second carded fiber web into relatively narrow rovings and forming a plurality of groups containing a plurality of the rovings with each group containing alternate rovings from across the width of the second carded web for evening the fiber distribution and weight in each group of rovings; and feeding the respective rovings from each such group into a separate coiling head of a textile coiler mechanism while combining all of the rovings of each group and forming a sliver of such rovings for use in spinning yarn in an open-end spinning machine without the necessity of subsequent doublings and draftings.

* * * * *